US005736291A

United States Patent [19]

Dalal et al.

[11] Patent Number: 5,736,291

[45] Date of Patent: *Apr. 7, 1998

[54] PROCESS FOR THE PREPARATION OF COLORED TONER AND DEVELOPER COMPOSITIONS

[75] Inventors: Edul N. Dalal, Webster; Sue E. Blaszak, Penfield; Kristen M. Natale-Hoffman, Rochester; Jacques C. Bertrand, Ontario; Roger N. Ciccarelli, Rochester; Denise R. Bayley, Fairport, all of N.Y.

[73] Assignee: Xerox Corporation, Stamford, Conn.

[ * ] Notice: The term of this patent shall not extend beyond the expiration date of Pat. No. 5,556,727.

[21] Appl. No.: 728,385

[22] Filed: Oct. 9, 1996

[51] Int. Cl.[6] ..... G03G 9/09

[52] U.S. Cl. ..... 430/137; 430/45; 430/106; 430/109; 430/111

[58] Field of Search ..... 430/45, 106, 137, 430/109, 111

[56] References Cited

U.S. PATENT DOCUMENTS

| | | | |
|---|---|---|---|
| 3,590,000 | 6/1971 | Palermiti et al. | 252/62.1 |
| 4,338,390 | 7/1982 | Lu | 430/106 |
| 5,114,821 | 5/1992 | Haack | 430/110 |
| 5,262,264 | 11/1993 | Shimizu et al. | 430/106 |
| 5,262,268 | 11/1993 | Bertrand et al. | 430/137 |
| 5,556,727 | 9/1996 | Ciccarelli et al. | 430/45 |

*Primary Examiner*—George F. Lesmes
*Assistant Examiner*—Cheryl Juska
*Attorney, Agent, or Firm*—E. O. Palazzo

[57] ABSTRACT

A combination of five colored toners containing resin and certain pigments of magenta, yellow, orange, red, and black, and processes for the preparation of these toners by, for example, mixing a cyan, magenta, orange, or red and yellow pigment water wet cake with toner resin, followed by substantially removing the water to generate pigmented resin.

5 Claims, No Drawings

PROCESS FOR THE PREPARATION OF COLORED TONER AND DEVELOPER COMPOSITIONS

APPLICATIONS AND PATENTS

In copending patent applications and patents U.S. Ser. No. 451,379, U.S. Ser. No. 449,130, now U.S. Statutory Invention Registration No. H1577, U.S. Ser. No. 452,241, U.S. Pat. No. 5,536,608, and U.S. Pat. No. 5,561,013, the disclosures of which are totally incorporated herein by reference, there are illustrated certain highlight color toners and processes thereof. More specifically, in U.S. Pat. No. 5,536,608, there is illustrated an imaging process which comprises (1) charging an imaging member in an imaging apparatus; (2) creating on the member a latent image comprising areas of high, intermediate, and low potential; (3) developing the low areas of potential with a first developer comprising carrier, and a first negatively charged toner comprised of resin, the cyan pigment Pigment Blue 15:3, Color Index number 74160:3, CAS Number 147-14-8, a mixture of charge enhancing additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto; and in U.S. Pat. No. 5,591,552 there is illustrated an imaging process which comprises (1) charging an imaging member in an imaging apparatus; (2) creating on the member a latent image comprising areas of high, intermediate, and low potential; (3) developing the low areas of potential with a first developer comprising carrier particles and a first negatively charged toner comprised of resin, the magenta pigment 2,9-dimethyl quinacridone, a charge additive, or a mixture of charge additives, and surface additives; (4) developing the high areas of potential with a second developer comprising carrier particles and a second black toner comprised of resin, pigment, and a charge enhancing additive that enables a positively charged toner; (5) transferring the resulting developed image to a substrate; and (6) fixing the image thereto.

Moreover, reference is made to the following copending applications and patents, the disclosures of each being totally incorporated herein by reference, U.S. Pat. No. 5,556,727, U.S. Pat. No. 5,591,552 U.S. Pat. No. 5,554,471, U.S. Pat. No. 5,607,804, U.S. Ser. No. 542,265, pending and U.S. Pat. No. 5,560,820 and relating to colored toners, or a combination of toners; and U.S. Ser. No. 08/728,317 pending, U.S. Ser. No. 08/729,225 pending, and U.S. Ser. No. 08/729,224 pending, the disclosures of each being totally incorporated herein by reference, and which illustrate, for example, a combination of five colored toners.

BACKGROUND OF THE INVENTION

The present inventions are generally directed to the use of five process color toners, and developer compositions thereof, and more specifically, the present invention is directed to developer and toner compositions with certain pigments, or mixtures thereof, wherein full color and HiFi, where true process colors are selected, developed images with excellent resolution can be obtained, and wherein high quality pigment dispersions are generated by flushing the pigments or by the use of dispersing agents during processing. In embodiments, the toners of the present invention contain flushed pigments, and wherein there is selected a wet pigment, or wet cake for each colored toner followed by heating to melt the resin or render it molten and thereafter shearing, and wherein water is removed or substantially removed from the pigment and there is generated in embodiments a polymer phase around the pigment enabling, for example, substantial, partial passivation of the pigment. A solvent can be added to the product obtained to provide a high quality dispersion of pigment and resin, and wherein the pigment is present in an amount of from about 25 to about 50, and preferably from about 30 to about 40 weight percent. Subsequently, the product obtained is mixed with a toner resin, which resin can be similar, or dissimilar than the resin mixed with the wet pigment, to provide a toner comprised of resin and pigment, and wherein in embodiments the pigment is present in an amount of from about 2 to about 20, and preferably from about 2 to about 15 weight percent based on the weight of the toner components of resin and pigment. In embodiments, there is formed one toner with five different pigments, or five toners with different pigments. There is provided in accordance with the present invention five colored toners with the colored pigment dispersed to a high quality state. The quality of the pigment dispersion as measured by Projection Efficiency is preferably between 70 percent and 98 percent as indicated herein. With the present invention, there is enabled a combination of toners with a large color gamut, especially in reflection developed images and with transparencies, and wherein with transparencies a substantial amount of scattered light, and embodiments most of the scattered light is eliminated allowing, for example, about 70 to about 98 percent (high quality pigment dispersion) of the transmitted light passing through a fused image on a transparency to reach the screen from an overhead projector. The toner and developer compositions of the present invention can be selected for electrophotographic, especially known xerographic imaging and printing processes, and more especially, full color processes.

Of importance with respect to the present invention in embodiments are the economical and environmentally friendly pigments, or mixtures of pigments selected for each toner, and the combination set, or gamut of toners, such as the cyan toner, the magenta toner, the orange or red toner, the yellow toner, and the black toner, as it is with these pigments that there is enabled the advantages of the present invention illustrated herein and including excellent stable triboelectric characteristics, acceptable stable admix properties, superior color resolution, the capability of obtaining any colors desired, that is a full color gamut, for example thousands of different colors and different developed color images, substantial toner insensitivity to relative humidity, toners that are not substantially adversely affected by environmental changes of temperature, humidity, and the like, the provision of separate toners, such as black, cyan, magenta, orange or red, and yellow toners, and mixtures thereof with the advantages illustrated herein, and which toners can be selected for the multicolor development of electrostatic images. The specific selection of colored toners together with having the pigments exceptionally well and substantially dispersed, and the image fused so that the image surface is smooth enables a large color gamut which assures that thousands of colors can be produced. The toner compositions of the present invention usually contain surface additives and may also contain charge additives, waxes, such as polypropylene, polyhydroxy compounds, such as the UNILINS® available from Petrolite Chemicals.

In embodiments of the present invention there are provided HiFi color processes wherein the color gamut refers to a range of colors that an imaging system can generate. One way of quantifying the color gamut is in terms of the number of pantone colors that the imaging device can produce. For example, there are about 1,000 standard pantone colors used in the graphic arts and about half of them can be produced by a typical four-color printing process, however, the remainder are outside of its color gamut. The specific HiFi toners and methods of the present invention in embodiments thereof involve the use of one or more additional process colors, such as orange or red, in addition to the usual cyan, magenta, yellow and black process colors. In HiFi color, the additional colors used are true process colors. In the image processing stage, the image is screened into the process color separations which are printed over each other. All possible mixtures (overprints) of the process colors can exist in the image. Thus, this method can produce all of the image colors that are between the 4-color gamut and the additional process color, such as orange. In contrast, in graphics arts pantone colors are traditionally printed by highlight color methods (four process colors plus a spot color). This requires hundreds of spot color inks. When pantone colors by the HiFi color method are generated in accordance with embodiments of the present invention, each additional process color, preferably orange, can produce many pantone colors by combinations with the other process colors. Thus, a single HiFi process color, such as red or orange, can generate up to 70 additional pantone colors.

Combination or set refers, in embodiments of the present invention, to separate toners that are not mixed together, rather each toner exists as a separate composition and each toner is incorporated into separate housings containing carrier in a xerographic machine, such as the Xerox Corporation 5775. For example, the cyan toner is present in one developer housing, the magenta toner is present in a second separate developer housing, the yellow toner is present in a third separate developer housing, the black toner is present in a fourth separate developer housing, and the orange or red toner is present in a fifth separate developer housing; and wherein each developer housing includes therein carrier particles such as those particles comprised of a core with a coating thereover.

Certain toner and developer compositions are known, including toners with specific pigments, such as magenta pigments like 2,9-dimethyl-substituted quinacridone and anthraquinone dye identified in the Color Index as CI 60710, CI Dispersed Red 15, diazo dye identified in the Color Index as CI 26050, CI Solvent Red 19; cyan pigments such as copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137; yellow pigments such as diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL; and black pigments such as REGAL 330® carbon black. Moreover, toners with certain colored pigments are illustrated in U.S. Pat. No. 5,262,264, the disclosure of which is totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions; U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Further, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Moreover, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635, which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, of interest are U.S. Pat. Nos. 5,262,264 and 5,437,949, the disclosures of which are totally incorporated herein by reference.

SUMMARY OF THE INVENTION

Examples of objects of the present invention illustrated herein include in embodiments:

It is an object of the present invention to provide development using five or more process colors.

It is another object of the present invention to provide toner and developer compositions with many of the advantages illustrated herein.

In another object of the present invention there are provided colored toner compositions with certain pigments, and which toners can be selected for the development of electrostatic latent images and the generation of full color developed images.

In yet another object of the present invention there are provided colored toners wherein an extensive gamut of different colors, or different color shades are enabled, and wherein one of the toners is orange or red with a pigment of Orange 13, Orange 34, Orange 15, Orange 16, Orange 36, Orange 46, Orange 67, Orange 69, Red 53:1, Red 48:1, Red 112, Red 254, or mixtures thereof.

Further, in another object of the present invention there are provided toners enabling an entire range, or an entire series of colors, such as reds, blues, greens, browns, yellows, pinks, violets, mixtures thereof of colors, and the like, and variations thereof like from light red to dark red and the reds therebetween, from light green to dark green and the greens therebetween, from light brown to dark brown and the browns therebetween, from light yellow to dark yellow and the yellows therebetween, from light violet to dark violet and the violets therebetween, from light pink to dark pink and the pinks therebetween, and the like.

Moreover, in another object of the invention there are provided toners with excellent high intensity color resolutions, and which toners possess high light transmission allowing about 70 to about 98 percent of the transmitted light passing through a fused image on a transparency to reach the screen from an overhead projector.

Also, in further objects of the invention there are provided toners prepared with flushed wet pigments or with the addition of dispersing agents.

Additionally, in other objects of the invention there are provided processes for the preparation of toners with flushed wetted pigments, followed by dilution with toner resin, and wherein the pigments are passivated in embodiments.

Another object of the invention is the provision of toners with excellent triboelectric characteristics, acceptable admix values of, for example, from about 15 to about 60 seconds, high or low gloss characteristics, for example a gloss of from about 40 to about 70 Gardner Gloss units with certain resins, such as polyesters, especially linear polyesters, such as the SPAR polyesters, such as those illustrated in U.S. Pat. No. 3,590,000, the disclosure of which is totally incorporated herein by reference; extruded polyesters with a gel content of from about 1 to about 40, and preferably from about 1 to about 10 percent, which polyesters are illustrated, for example, in U.S. Pat. Nos. 5,376,494 and 5,227,460, the disclosures of which are totally incorporated herein by reference.

In objects of the present invention there are provided toners that are substantially insensitive to relative humidities at various temperatures, for example from 25° to about 95° C.

Also, in another object of the invention illustrated herein there are provided developer compositions with toner particles, and carrier particles.

In a further object of the present invention there are provided humidity insensitive, from about, for example, 20 to 80 percent relative humidity at temperatures of from 60° to 80° F. as determined in a relative humidity testing chamber, positively or negatively charged colored toner compositions with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Another object of the present invention resides in the formation of toners which will enable the development of images in electrophotographic imaging and printing apparatuses, including digital, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

Moreover, in another object of the present invention there is provided a combination of unmixed separated toners, and which combination can be incorporated into an imaging apparatus, such as modified Xerox Corporation 5775 and 5760 full process color machines, and wherein, for example, each of five toners can be selected to develop and provide images of a variety of colors, and more specifically, any color that is present on the original being copied, and wherein the image copied is substantially the same as the original image in color, color resolution, and color intensity, and further wherein orange or red images can be obtained, or orange highlights generated.

These and other objects of the present invention can be accomplished in embodiments thereof by providing toner compositions comprised of resin particles, pigment particles, and which toners can contain charge enhancing additives, waxes, polyhydroxy alcohols, such as the UNILINS® available from Petrolite Chemicals, and surface additives of, for example, silicas, metal oxides, metal salts of fatty acids, mixtures thereof, and the like.

In embodiments of the present invention there are provided developers containing toners comprised of a cyan toner, a magenta toner, a yellow toner, an orange or red toner, and a black toner, each of said toners being comprised of resin and pigment, and wherein the pigment for the orange toner is Pigment 13, C.I. (color index number) 21110, a disazo available from Sun Chemicals, Pigment Orange 34, C.I. 21115, a diarylide available from Sun Chemical, Pigment Orange 5, C.I. 12075, a monoazo available from Sun Chemical, Pigment Orange 16, C.I. 21160, a disazo available from Sun Chemical, Pigment Orange 36, C.I. 11780, a monoazo available from Sun Chemical, Pigment Orange 46, C.I. 15602, a monoazo available from Sun Chemical, Pigment Orange 67, C.I. number not assigned yet, an azo orange pigment available from BASF Corporation, Pigment Orange 69, C.I. number not assigned yet, an Isoindoline available from BASF Corporation, and wherein the pigment for the red toner is Pigment Red 53:1, C.I. 15585, a monoazo available from Sun Chemical, Pigment Red 48:1, C.I. 15865:1, a monoazo available from Sun Chemical, Pigment Red 122, C.I. 12370, a monoazo available from BASF, or Pigment Red 254, C.I. number not assigned yet, a diketopyrrolopyrrol available from Ciba Geigy, and wherein the pigment is prepared as illustrated herein.

Embodiments of the present inventions include a toner, preferably a toner combination comprised of a cyan toner, a magenta toner, a yellow toner, an orange toner, or a red toner, and a black toner, each of said toners being comprised of resin and pigment, and wherein the pigment for the cyan toner is a β or beta type copper phthalocyanine, the pigment for the magenta toner is a xanthene silicomolybdic acid salt of Rhodamine 6G basic dye, the pigment for the yellow toner is a diazo benzidine, the pigment for the orange toner is Pigment Orange 13, or Pigment Orange 34, Orange 5, Orange 16, Orange 36, Orange 46, Orange 67, Orange 69, Red 53:1, Red 48:1, Red 112, or Red 254, and the pigment for the black toner is carbon black; a combination of five color toners for the development of electrostatic latent images enabling the formation of a full color gamut image and wherein the five toners are comprised of a cyan toner, a magenta toner, a yellow toner, an orange or red toner, and a black toner, respectively, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, the pigment for the orange or red orange toner is Orange or Red 13, or Orange 34, Orange 5, Orange 16, Orange 36, Orange 46, Orange 67, Orange 69, Red 53:1, Red 48:1, Red 112, or Red 254, and the pigment for the black toner is carbon black; wherein said cyan pigment is Pigment Blue 15:3 having a Color Index Constitution Number of 74160, said magenta pigment is Pigment Red 81:3 having a Color Index Constitution Number of 45160:3, said yellow pigment is pigment Yellow 17 having a Color Index Constitution Number of 21105, wherein each of the pigments are present in an amount of from about 2 to about 20 weight percent based on the weight percent of resin and pigment; wherein each of said pigments is present in an amount of from about 2 to about 10 weight percent based on the weight percent of resin and pigment; wherein each of said cyan, magenta, orange, red, and yellow pigments possesses a diameter particle size or agglomerate diameter size of from about 0.01 micron to about 3 microns; wherein each of said cyan, magenta, orange and yellow pigments is of a particle diameter size or agglomerate diameter size of from about 0.01 micron to about 0.3 micron and the black pigment is of a particle diameter size of from about 0.001 micron to about 0.1 micron; wherein each of said cyan, magenta, orange, red, and yellow pigments has a particle diameter size or agglomerate diameter size of from about 0.01 micron to about 0.3 micron, and said pigments are dispersed into said toner resin uniformly to thereby minimize light scattering and increase color gamut in reflection copy and overhead transparency copy; wherein each of said cyan, magenta, orange, red, and yellow pigments is dispersed by flushing said cyan, magenta, orange, and yellow pigments into said toner resin, and wherein a cyan, magenta, orange, and yellow pigment water wet cake is mixed with toner resin, and the water is removed to generate pigmented resin containing from about 25 to about 50 weight percent of pigment based on the weight percent of said toner resin and said pigment; wherein each of said cyan, magenta, orange, and yellow pigments is dispersed by flushing said cyan, magenta, orange, and yellow pigments into said toner resin, and wherein a cyan, magenta, orange, and yellow pigment water wet cake is mixed with toner resin and the water is removed to generate pigmented resin containing from about 25 to about 50 weight percent of pigment by weight, and wherein each of the resulting pigmented resin concentrate product is mixed and diluted with additional toner resin to generate cyan, magenta, orange, and yellow toners containing each of said cyan, magenta, orange, and yellow pigment, respectively, in an amount from about 2 to about 20 weight percent; wherein the fused image obtained with said combined, set, or gamut of toners has a Gardner Gloss value of from about 12 to 75 gloss units; a combination set, or gamut of five color toners each for the development of electrostatic latent images enabling the formation of a full color gamut image, and wherein the five toners are comprised of a cyan toner, a magenta toner, a yellow toner, a certain orange toner, or a certain red toner, and a black toner, each of said toners being comprised of resin and pigment, and wherein the pigment for the cyan toner is a β copper phthalocyanine; the pigment for the magenta toner is a xanthene silicomolybdic acid salt of Rhodamine 6G basic dye; the pigment for the yellow toner is a diazo benzidine; the pigment for the orange toner is Pigment 13, or Pigment 34, Pigment Orange 5, Pigment Orange 16, Pigment Orange 36, Pigment Orange 46, Pigment Orange 67, or Pigment Orange 69; the pigment of the red toner is Pigment Red 53:1, Pigment Red 48:1, Pigment Red 112, or Pigment Red 254; and the pigment for the black toner is carbon black; and an imaging process which comprises the generation of an electrostatic image on a photoconductive imaging member followed by the development thereof with a combination, set, or gamut of toners, and wherein five toners are selected, and which toners are comprised of a cyan toner, a magenta toner, an orange or red toner, a yellow toner, and a black toner, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, the pigment for the orange toner is 13 or 34 orange, or Orange 5, Orange 16, Orange 36, Orange 46, Orange 67, Orange 69, and the pigment for the red toner is Red 53:1, Red 48:1, Red 112, or Red 254, and the pigment for the black toner is carbon black; thereafter, transferring the developed image to a substrate, and fixing the image thereto.

Embodiments of the present invention also include a toner comprised of a mixture of a cyan toner, a magenta toner, an orange toner, a yellow toner, and a black toner, each of said toners being comprised of resin and pigment, and wherein the pigment for the cyan toner is a β or beta type copper phthalocyanine, the pigment for the magenta toner is a xanthene silicomolybdic acid salt of Rhodamine 6G basic dye, the pigment for the yellow toner is a diazo benzidine, and the pigment for the black toner is carbon black, a cyan toner, a magenta toner, a yellow toner and a black toner; and wherein each toner is comprised of thermoplastic resin and certain pigments, or colorants for each toner, such as for the cyan toner a β (beta) type copper phthalocyanine like Pigment Blue 15:3 having a Color Index Constitution Number of 74160, for the magenta toner a xanthene silicomolybdic acid salt of Rhodamine 6G basic dye like Pigment Red 81:3 having a Color Index Constitution Number of 45160:1, for the yellow toner a diazo benzidine like Pigment Yellow 17, and/or Pigment Yellow 12, and/or Pigment Yellow 13, and/or Pigment Yellow 14 having, respectively, Color Index Constitution Numbers of 21105, 21090, 21100, and 21095, and for the black toner a carbon black, such as those carbon blacks available from Columbian Chemicals, and Cabot Corporation like REGAL 330® carbon black, and the like, and the pigment for the orange or red toner being 13 or 34 orange, Orange 5, Orange 16, Orange 36, Orange 46, Orange 67, Orange 69, Red 53:1, Red 48:1, Red 112, or Red 254, or mixtures thereof. The colorants or pigments are present in each final toner in various effective amounts, such as from about 2 to about 25, and preferably from about 2 to about 15 weight percent based on the toner components of resin and pigment. Examples of Pigment Blue 15:3 include Heliogen Blue available from BASF, and Phthalocyanine Blue available from Sun Chemicals; examples of Pigment Red 81:3 are FANAL PINK D4830™ available from BASF and Rhodamine Y.S. available from Sun Chemical; examples of Pigment Yellow 17, the preferred pigment in embodiments, is Diarylide AAOA Yellow available from Sun Chemicals; and examples of Pigment Yellow 12, Pigment Yellow 13, and Pigment Yellow 14 are diarylide yellow, diarylide yellow, and diarylide yellow available from Sun Chemicals. Examples of orange and red pigments are Pigment 13, C.I. 21110, a disazo available from Sun Chemicals, Pigment Orange 34, C.I. 21115, a diarylide available from Sun Chemical, Pigment Orange 5, C.I. 12075, a monoazo available from Sun Chemical, Pigment Orange 16, C.I. 21160, a disazo available from Sun Chemical, Pigment Orange 36, C.I. 11780, a monoazo available from Sun Chemical, Pigment Orange 46, C.I. 15602, a monoazo available from Sun Chemical, Pigment Orange 67, C.I. number not assigned yet, an azo pigment available from BASF Corporation, Pigment Orange 69, C.I. number not assigned yet, an Isoindoline available from BASF Corporation, Pigment Red 53:1, C.I. 15585, a monoazo available from Sun Chemical, Pigment Red 48:1, C.I. 15865:1, a monoazo available from Sun Chemical, Pigment Red 122, C.I. 12370, a monoazo available from BASF, and Pigment Red 254, C.I. number not assigned yet, a diketo-pyrrolopyrrol available from Ciba Geigy. Usually either the orange or red pigment is present, that is the orange or red toner is selected in embodiments, and not both. These color pigments are recited in *The Color Index*, Third Edition, Volumes 1 to 8, the disclosures of which are totally incorporated herein by reference. The amount of each color pigment present is preferably from about 2 to about 15 weight percent based on the toner components of resin and pigment. The exact amount of each pigment present in the toner is determined by the mass of toner deposited on a reflection copy, and adjusting the pigment concentration to achieve the maximum color gamut. This will enable the production of thousands of different colors and/or color shades. This amount can be determined by measuring the chroma of the color image and setting the pigment concentration at or about the maximum chroma. For determination of chroma reference is made to *Principals of Color Technology, 2nd Edition*, F. W. Billmeyer, Jr. and M. Saltzman, John Wiley & Son, 1981, the disclosures of which are totally incorporated herein by reference.

Further, in embodiments there are provided toner compositions comprised of a cyan toner, a magenta toner, an orange toner with Orange 13, or Orange 34, a yellow toner and a black toner, and wherein each toner is comprised of thermoplastic resin and certain pigments, or colorants for each toner, such as for the cyan toner a β type copper phthalocyanine, like Pigment Blue 15:3 having a Color Index Constitution Number of 74160, for the magenta toner a xanthene silicomolybdic acid salt of Rhodamine 6G basic dye, P.R. 81:3 like Pigment Red 81:3 having a Color Index Constitution Number of 45160:3, for the yellow toner a diazo benzidine like Pigment Yellow 17, and/or Pigment Yellow 12, and/or Pigment Yellow 13, and/or Pigment Yellow 14 and/or Pigment Yellow 74, and/or Pigment Yellow 180 having, respectively, Color Index Constitution Numbers of 21105, 21090, 21100, and 21095, 11741 and no C.I. number issued for PY 180 and for the black toner a carbon black, such as those carbon blacks available from Columbian Chemicals, and Cabot Corporation like REGAL 330® carbon black, and the like. The colorants or pigments are present in each toner in various effective amounts, such as from about 2 to about 20, and preferably from about 2 to about 15 weight percent based on the toner components of resin and pigment. Examples of Pigment Blue 15:3 include Heliogen Blue available from BASF, and Phthalocyanine Blue available from Sun Chemical; an example of Pigment Yellow 17, the preferred pigment in embodiments, is Diarylide AAO Yellow available from Sun Chemical.

Moreover, in embodiments there are provided toner compositions comprised of a cyan toner, a magenta toner, an orange toner with Orange 13, or Orange 34, Orange 5, Orange 16, Orange 36, Orange 46, Orange 67, Orange 69, and the red pigment Red 53:1, Red 48:1, Red 112, or Red 254, a yellow toner and a black toner; and wherein each toner is comprised of thermoplastic resin and certain pigments, or colorants for each toner, such as for the cyan toner, a beta copper phthalocyanine like Pigment Blue 15:3 having a Color Index Constitution Number of 74160, for the magenta toner a monoazo lithol rubine like Pigment Red 57:1 having a Color Index Constitution Number of 15850:1, for the yellow toner Yellow 12, and for the black toner a carbon black, such as those carbon blacks available from Columbian Chemicals, and Cabot Corporation like REGAL 30® carbon black, and the like. The colorants or pigments are present in each toner in various effective amounts, such as from about 2 to about 20, and preferably from about 2 to about 15 weight percent based on the toner components of resin and pigment. Examples of Pigment Blue 15:3 include Heliogen Blue available from BASF, and Phthalocyanine Blue available from Sun Chemical.

Additionally, in embodiments there are provided toner compositions comprised of a cyan toner, a magenta toner, an orange toner with Orange 34, Orange 13, Orange 5, Orange 16, Orange 36, Orange 46, Orange 67, Orange 69, Red 53:1, Red 48:1, Red 112, or Red 254, a yellow toner and a black toner; and wherein each toner is comprised of thermoplastic resin and certain pigments, or colorants for each toner, such as for the cyan toner β type copper phthalocyanine like Pigment Blue 15:3 having a Color Index Constitution Number of 74160, and/or a metal free phthalocyanine, such as Pigment Blue 16 having a Color Index Constitution Number of 74100, for the magenta toner a xanthene silicomolybdic acid salt of Rhodamine 6G basic dye like Pigment Red 81:3 having a Color Index Constitution Number of 45160, and/or a quinacridone, such as Pigment Red 122 having a Color Index Constitution Number of 73915, and/or a monoazo lithol rubine like Pigment Red 57:1 having a Color Index Constitution Number of 15850:1, for the yellow toner a diazo benzidine like Pigment Yellow 17, and/or Pigment Yellow 12, and/or Pigment Yellow 13, and/or Pigment Yellow 14, Pigment Yellow 74, and/or Pigment Yellow 180 having, respectively, Color Index Constitution Numbers of 21105, 21090, 21100, and 21095, 11741, and C.I. Number not issued yet and/or an isoindoline like Pigment Yellow 185, and for the black toner a carbon black, such as those carbon blacks available from Columbian Chemicals, and Cabot Corporation, like REGAL 330® carbon black, and the like. The colorants or pigments are present in each toner in various effective amounts, such as from about 2 to about 20, and preferably from about 2 to about 15 weight percent, based on the toner components of resin and pigment. Examples of Pigment Blue 15:3 include Heliogen Blue available from BASF, and Phthalocyanine Blue available from Sun Chemical; examples of Pigment Blue 16 are Heliogen Blue available from BASF, and examples of the other pigments, such as the yellow, are as indicated herein. The aforementioned five toners can be admixed in various effective amounts, such as from about 10 to about 25 weight percent, providing that the total is about 100 weight percent. For mixtures, various effective amounts of each pigment may be selected, for example from about 1 to about 99 weight percent of a first pigment, and from about 99 to 1 weight percent of a second pigment.

In embodiments, there is provided a combination of separate toner compositions comprised of a cyan toner, a magenta toner, an orange toner with 13 or 34 Orange, Orange 5, Orange 16, Orange 36, Orange 46, Orange 67, Orange 69, and/or a red toner with, for example, Red 53:1, Red 48:1, Red 112, or Red 254, a yellow toner and a black toner, and wherein each toner is comprised of thermoplastic resin and certain pigments, or colorants for each toner, such as for the cyan toner β type copper phthalocyanine like Pigment Blue 15:3 having a Color Index Constitution Number of 74160, for the magenta toner a quinacridone, such as Pigment Red 122 having a Color Index Constitution Number of 73915, for the yellow toner an isoindoline yellow like Pigment Yellow 185 with a Color Index Constitution Number of 56290, and for the black toner a carbon black, such as those carbon blacks available from Columbian Chemicals, and Cabot Corporation like REGAL 330® carbon black, and the like. The colorants or pigments are present in each toner in various effective amounts, such as from about 2 to about 20, and preferably from about 2 to about 15 weight percent, based on the toner components of resin and pigment. Examples of Pigment Blue 15:3 include Heliogen Blue available from BASF, and examples of the magenta and yellow are as indicated herein.

Also, embodiments of the present invention include a xerographic imaging and printing apparatus comprised in operative relationship of an imaging member component, a charging component, five development components, a transfer component, and a fusing component, and wherein said development components include therein carrier and five separate color toners, respectively, and wherein the five toners are comprised of a cyan toner, a magenta toner, a yellow toner, an orange toner, and a black toner, as illustrated herein, respectively, each of said toners being comprised, for example, of resin and pigment, and wherein, for example, the pigment for the cyan toner is a β copper phthalocyanine, the pigment for the magenta toner is a xanthene silicomolybdic acid salt of Rhodamine 6G basic dye, the pigment for the yellow toner is a diazo benzidine, the pigment for the yellow toner is Orange 13, Orange 34, Orange 5, Orange 16, Orange 36, Orange 46, Orange 67, Orange 69, and for the red toner when present is Red 53:1, Red 48:1, Red 112, or Red 254 and the pigment for the black toner is carbon black, and wherein in embodiments said developer components are comprised of five separated housings, and wherein one housing contains the cyan toner, the second housing contains a magenta toner, the third housing contains the yellow toner, the fourth housing contains the black toner, and the fifth housing contains the orange or red toner, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, the pigment for the black toner is carbon black, the pigment for the orange or red toner is 13 Orange, or 34 Orange, wherein said cyan pigment is Pigment Blue 15:3 having a Color Index Constitution Number of 74160, said magenta pigment is Pigment Red 81:3 having a Color Index Constitution Number of 45160:3, said yellow pigment is Pigment Yellow 17 having a Color Index Constitution Number of 21105, and the imaging member is comprised of a photogenerating layer and a charge transport layer.

Of importance when preparing the toner in embodiments is the selection of a wet pigment, or wet cake of pigment, that is a pigment that has been wetted with water and not a dry pigment. These pigments are flushed into the toner resin by the mixing thereof with toner resin and heating, for example, at a temperature of from about 50° to about 125° C., and wherein the water is removed, or substantially removed. Solvents, such as organic solvents like toluene, xylene, and the like, can be added in effective amounts to the wet pigment prior to mixing with the toner resin. In embodiments, the pigment concentration in the toner product resulting after heating and cooling is from about 25 to about 50, and preferably from about 25 to about 45 weight percent. Thereafter, the products of toner resin and pigment can be diluted by adding thereto further toner resin, such as a polyester, and wherein the amount of pigment present is reduced, for example, to from about 2 to about 15 weight percent.

The toner compositions of the present invention can be prepared in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include thermoplastics, such as polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polyesters generally, such as the polymeric esterification products of a dicarboxylic acid and a diol comprising a diphenol, reference the known linear polyesters, the polyesters of U.S. Pat. No. 3,590,000, the disclosure of which is totally incorporated herein by reference, the SPAR™ polyesters commercially available, and the like. Vinyl monomers include styrene, p-chlorostyrene, unsaturated mono-olefins such as ethylene, propylene, butylene, isobutylene, and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof, and the like; styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers and polyesters, such as those illustrated in U.S. Pat. No. 3,681,106, the disclosure of which is totally incorporated herein by reference, may be selected. Examples of specific toner resins include styrene n-butyl methacrylate, styrene n-butyl acrylate, styrene butadiene with from 80 to 91 weight percent styrene, and PLIOTONES®, which are believed to be styrene butadienes available from Goodyear Chemicals.

As one preferred toner resin, there can be selected the esterification products of a dicarboxylic acid and a diol comprising a diphenol, such as SPAR™ polyesters available from Resana of Brazil. These resins are generally illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a weight average molecular weight of from about 1,000 to about 20,000, and preferably from about 1,000 to about 10,000, such as polyolefins like polyethylene, polypropylene, and paraffin waxes, can be included in, or on the toner compositions as, for example, fuser roll release agents. These low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Also, the extruded polyesters as illustrated In U.S. Pat. Nos. 5,376,494 and 5,227,460, the disclosures of which are totally incorporated herein by reference, can be selected as the toner resin. More specifically, these polyesters are comprised of crosslinked and linear portions, the crosslinked portion consisting essentially of microgel particles with an average volume particle diameter up to 0.1 micron, preferably about 0.005 to about 0.1 micron, the microgel particles being substantially uniformly distributed throughout the linear portions. The extruded polyesters in embodiments are comprised of crosslinked portions consisting essentially of microgel particles, preferably up to about 0.1 micron in average volume particle diameter, as determined by scanning electron microscopy and transmission electron microscopy. When produced by a reactive melt mixing process wherein the crosslinking occurs at high temperature and under high shear, the size of the microgel particles does not usually continue to grow with increasing degree of crosslinking. Also, the microgel particles are distributed substantially uniformly throughout the linear portion.

There can be blended with the toner compositions of the present invention external additive particles including flow aid additives, which additives are usually present on the surface thereof. Examples of these additives include colloidal silicas, such as the AEROSILS® like AEROSIL R972®, available from Degussa Chemicals, mixtures of AEROSILS® in embodiments, metal salts and metal salts of fatty acids inclusive of zinc stearate, metal oxides, such as aluminum oxides, titanium oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with charge additives in an amount of from about 1 to about 30 weight percent and preferably 10 weight percent, followed by the addition thereof to the toner in an amount of from 0.1 to 10 and preferably 0.1 to 1 weight percent.

Also, as indicated herein there can be included in the toner compositions of the present invention polyhydroxy alcohols, and/or low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar waxes. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyolefins, such as polyethylene and polypropylene selected for the toners of the present invention are illustrated in British Patent 1,442,835, the disclosure of which is totally incorporated herein by reference.

The alcohols, and/or low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Various known suitable effective positive or negative charge enhancing additives can be selected for incorporation into the toner compositions of the present invention, preferably in an amount of about 0.1 to about 10, more preferably about 1 to about 3, percent by weight. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; bisulfonates; ammonium sulfates (DDABS); distearyl dimethyl ammonium bisulfate (DDAMS), reference U.S. Pat. No. 5,114,821, the disclosure of which is totally incorporated herein by reference; cetyl pyridinium tetrafluoroborates; distearyl dimethyl ammonium methyl sulfate; aluminum salts, such as BONTRON E84™ or E88™ (Hodogaya Chemical); quaternary ammonium nitrobenzene sulfonates; mixtures of charge enhancing additives, such as DDAMS and DDABS; other known charge additives; and the like. Moreover, effective known internal and external additives may be selected for the toners of the present invention in embodiments thereof.

The invention toners can be formulated into developer compositions by the mixing thereof with carrier particles. Illustrative examples of carriers that can be selected for mixing with the toner compositions include those carriers that are capable of triboelectrically obtaining a charge of opposite polarity to that of the toner particles. Accordingly, in embodiments the carrier particles may be selected so as to be of a negative or of a positive polarity in order that the toner particles, which are positively or negatively charged, will adhere to and surround the carrier particles. Illustrative examples of carriers include granular zircon, granular silicon, glass, steel, iron, nickel, ferrites, such as copper zinc ferrites, copper manganese ferrites, and strontium hexaferrites, silicon dioxide, and the like. Additionally, there can be selected as carrier particles nickel berry carriers as disclosed in U.S. Pat. No. 3,847,604, the disclosure of which is totally incorporated herein by reference, and which carriers are, for example, comprised of nodular carrier beads of nickel, characterized by surfaces of reoccurring recesses and protrusions thereby providing particles with a relatively large external area. Other carriers are illustrated in U.S. Pat. Nos. 3,590,000; 4,937,166 and 4,935,326, the disclosures of which are totally incorporated herein by reference. In embodiments, mixtures of coatings, such as KYNAR® and PMMA as illustrated in the aforementioned U.S. Pat. Nos. 4,937,166 and 4,935,326, mixtures of three polymers, mixtures of four polymers, polymer mixture pairs wherein each pair contains a conductive carrier coating, and an insulating carrier coating can be selected. The carrier coating can be selected in various effective amounts, such as for example from about 0.1 to about 10, and preferably from about 1 to about 3 weight percent. Also, in embodiments the carrier core may be entirely coated on the surface thereof, or partially coated.

The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings, such as fluoropolymers like KYNAR®, TEFLON OXY 461® available from Occidental Chemicals; and the like. The carrier particles may also include in the coating, which coating can be present in embodiments in an amount of from about 0.1 to about 3 weight percent, conductive substances, such as carbon black, in an amount of from about 5 to about 30 percent by weight. Polymer coatings not in close proximity in the triboelectric series can also be selected as indicated herein, reference KYNAR® and polymethylmethacrylate (PMMA) mixtures (40/60) as illustrated in U.S. Pat. Nos. 4,937,166 and 4,935,326, the disclosures of which are totally incorporated herein by reference. Coating weights can vary as indicated herein; generally, however, in embodiments from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from about 60 to about 100 microns thereby permitting them to possess sufficient density and inertia to avoid adherence to the electrostatic images during the development process. The carrier component can be mixed with the toner in various suitable combinations, such as from about 1 to 5 parts per toner to about 100 parts to about 200 parts by weight of carrier.

The toner and developer compositions of the present invention may be selected for use in electrostatographic imaging apparatuses containing therein conventional photoreceptors providing that they are capable of being charged negatively. The toner and developer compositions of the present invention can be used with layered photoreceptors, or photoconductive imaging members that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Preferred imaging members include the layered imaging members with a supporting substrate, a photogenerating layer and a charge transport layer.

In embodiments, the pigment for each toner is prepared by dispersing the pigment in a polymeric alcohol, preferably UNILIN®, reference U.S. Pat. No. 4,883,736, the disclosure of which is totally incorporated herein by reference.

The following Examples are being provided to illustrate various embodiments of the present invention, it being noted that these Examples are intended to illustrate and not limit the scope of the present invention. Parts and percentages are by weight unless otherwise indicated. Weight percent refers, for example, to the amount of component divided by the total amount of components, for example for the toner the weight percent of pigment is based on the weight percent of the toner components of resin, pigment, and optional charge additive In the Examples, about 3 parts of toner and 97 parts of the Xerox Corporation carrier were selected. Also, other toners were prepared as illustrated.

EXAMPLE I

Pigment Orange 13 having a Color Index Constitution Number 21110 was dispersed in a propoxylated bisphenol A linear polyester resin commercially available with the addition of UNILIN 425®, a polymeric alcohol wax obtained from Petrolite Chemicals, having a molecular weight of 425 as a dispersing agent. A toner was prepared utilizing a Banbury Rubber Mill with the following process conditions: Ram time down—2 minutes at 160° F., ram time up—3 minutes at 178° F., ram pressure 20 psi, rotor speed 115 rpm, rubber mill time—5 minutes at 100 mil gap, front roll speed—30 F.P.M., back roll speed 40 F.P.M. cooling on and Fitz Screen Number 3. A mixture of 96 parts of the above linear polyester resin obtained from bisphenol A, fumaric acid and propylene glycol, 2 parts of the Pigment Orange 13, and 2 parts of UNILIN 425® wax were mixed. The resulting mixture was then cooled and micronized using conventional jet mill process to 7 microns average volume median size.

EXAMPLE II

Pigment Orange 34 having a Color Index Constitution Number 21115 was dispersed in a propoxylated bisphenol A linear polyester resin commercially available with the addition of UNILIN® wax as a dispersing agent. A toner was prepared utilizing a Banbury Rubber Mill with the following process conditions: Ram time down—2 minutes at 160° F., ram time up—3 minutes at 178° F., ram pressure 20 psi, rotor speed 115 rpm, rubber mill time—5 minutes at 100 mil gap, front roll speed in feet per minute—30 F.P.M., back roll speed 40 F.P.M. cooling on and Fitz Screen Number 3. A mixture of 96 parts of the above linear polyester resin obtained from bisphenol A, fumaric acid and propylene glycol, 2 parts of the Pigment Orange 34, and 2 parts of UNILIN 425® wax were mixed. The resulting mixture was then cooled and micronized using conventional jet mill process to 7 microns average volume median size.

EXAMPLE III

Pigment Orange 13 having a Color Index Constitution Number 21110 was predispersed in a propoxylated bisphenol A linear polyester resin commercially available and illustrated in U.S. Pat. No. 3,590,000, the disclosure of which is totally incorporated herein by reference, by using a flushing procedure as follows.

In an Aaron Process Company lab mixer equipped with a two horsepower direct connect gear motor and mixing blades of sigma design with front blade speed set at 60 RPM and back blade speed set at 34 RPM (a flusher), 1,600 grams of the linear polyester plus 160 grams of toluene were mixed and heated to 65° C. until the resin was completely dissolved. The Pigment Blue 15:3 was added in three aliquots to the mix in the wet cake form which is a 50/50 weight ratio of Pigment Orange 13 and water as follows. 1,000 Grams of Pigment Orange 13 wet cake (which contains 50 percent of water) were added to the resin/toluene mixture. The water from the wet cake pigment was displaced by the resin/toluene solution (flushed) and the water was decanted. Another 567 grams of the same wet cake was added to the mix, allowed to mix, and the water was displaced from the pigment and decanted. Finally, the last aliquot of wet cake, 567 grams, was added and allowed to mix with the resin/toluene, and for a third time the water was displaced from the pigment, and again the water was decanted. The mixture of resin/toluene/pigment was further mixed for one hour at 65° C. The mixture was then subjected to vacuum to remove the toluene and any entrapped water from the resin/pigment mixture. The mixture was then cooled and crushed to a powder. The resulting Pigment Blue 15:3 flush contained 60/40 weight ratio of resin/pigment.

A toner was prepared with the above prepared predispersed pigment utilizing a Werner & Pfleiderer ZSK-28 twin screw extruder with the following process conditions: barrel temperature profile of 105°/110°/110°/115°/115°/115°/120° C., die head temperature of 140° C., screw speed of 250 revolutions per minute and average residence time of about three minutes. With the processing rate at 6 pounds per hour, a mixture of 90 parts of the above linear polyester resin obtained from bisphenol A, fumaric acid and propylene glycol, and 10 parts of the Pigment Orange 13 flush were mixed. The resulting mixture was then cooled, micronized and classified using conventional jet mill process to 7 microns average volume median size. The resulting colored toner contained 96 parts of the linear polyester resin and 4 parts of Pigment Orange 13, which pigment had a particle size of 0.1 micron average particle diameter as measured by transmission electron microscopy.

EXAMPLE IV

Pigment Orange 34 with a Color Index Constitution Number 21115 was predispersed in a propoxylated bisphenol A linear polyester resin commercially available and illustrated in U.S. Pat. No. 3,590,000, the disclosure of which is totally incorporated herein by reference, by using a flushing procedure as follows.

In an Aaron Process Company lab mixer equipped with a two horsepower direct connect gear motor and mixing blades of sigma design with front blade speed set at 60 RPM and back blade speed set at 34 RPM (a flusher), 1,600 grams of the linear polyester plus 160 grams of toluene were mixed and heated to 65° C. until the resin was completely dissolved. The Pigment Blue 15:3 was added in three aliquots to the mix in the wet cake form which is a 50/50 weight ratio of Pigment Orange 34 and water as follows. 1,000 Grams of Pigment Orange 34 wet cake (which contains 50 percent of water) were added to the resin/toluene mixture. The water from the wet cake pigment was displaced by the resin/toluene solution (flushed) and the water was decanted. Another 567 grams of the same wet cake was added to the mix, allowed to mix, and the water was displaced from the pigment and decanted. Finally, the last aliquot of wet cake, 567 grams, was added and allowed to mix with the resin/toluene, and for a third time the water was displaced from the pigment, and again the water was decanted. The mixture of resin/toluene/pigment was further mixed for one hour at 65° C. The mixture was then subjected to vacuum to remove the toluene and any entrapped water from the resin/pigment mixture. The mixture was then cooled and crushed to a powder. The resulting Pigment Orange 34 flush contained 60/40 weight ratio of resin/pigment.

A toner was prepared with the above prepared predispersed pigment utilizing a Werner & Pfleiderer ZSK-28 twin screw extruder with the following process conditions: barrel temperature profile of 105°/110°/110°/115°/115°/115°/120° C., die head temperature of 140° C., screw speed of 250 revolutions per minute and average residence time of about three minutes. With the processing rate at 6 pounds per hour, a mixture of 90 parts of the above linear polyester resin obtained from bisphenol A, fumaric acid and propylene glycol, and 10 parts of the Pigment Orange 34 flush were mixed. The resulting mixture was then cooled, micronized and classified using conventional jet mill process to 7 microns average volume median size. The resulting orange colored toner contained 96 parts of the linear polyester resin and 4 parts of Pigment Orange 34, which pigment had a particle size of 0.1 micron average particle diameter as measured by transmission electron microscopy.

EXAMPLE V

Pigment Blue 15:3 having a Color Index Constitution Number 74160 was predispersed in a propoxylated bisphenol A linear polyester resin commercially available and illustrated in U.S. Pat. No. 3,590,000, the disclosure of which is totally incorporated herein by reference, by using a flushing procedure as follows.

In an Aaron Process Company lab mixer equipped with a two horsepower direct connect gear motor and mixing blades of sigma design with front blade speed set at 60 RPM and back blade speed set at 34 RPM (a flusher), 1,600 grams of the linear polyester plus 160 grams of toluene were mixed and heated to 65° C. until the resin was completely dissolved. The Pigment Blue 15:3 was added in three aliquots to the mix in the wet cake form which is a 50/50 weight ratio of Pigment Blue 15:3 and water as follows. 1,000 Grams of Pigment Blue 15:3 wet cake (which contains 50 percent of water) were added to the resin/toluene mixture. The water from the wet cake pigment was displaced by the resin/toluene solution (flushed) and the water was decanted. Another 567 grams of the same wet cake were added to the mix, allowed to mix, and the water was displaced from the pigment and decanted. Finally, the last aliquot of wet cake, 567 grams, was added and allowed to mix with the resin/toluene, and for a third time the water was displaced from the pigment, and again the water was decanted. The mixture of resin/toluene/pigment was further mixed for one hour at 65° C. The mixture was then subjected to vacuum to remove the toluene and any entrapped water from the resin/pigment mixture. The mixture was then cooled and crushed to a powder. The resulting Pigment Blue 15:3 flush contained 60/40 weight ratio of resin/pigment.

A toner was prepared with the above prepared predispersed pigment utilizing a Werner & Pfleiderer ZSK-28 twin screw extruder with the following process conditions: barrel temperature profile of 105°/110°/110°/115°/115°/115°/120° C., die head temperature of 140° C., screw speed of 250 revolutions per minute and average residence time of about three minutes. With the processing rate at 6 pounds per hour, a mixture of 90 parts of the above linear polyester resin obtained from bisphenol A, fumaric acid and propylene glycol, and 10 parts of the Pigment Blue 15:3 flush were mixed. The resulting mixture was then cooled, micronized and classified using conventional jet mill process to 7 microns average volume median size. The resulting colored toner contained 96 parts of the linear polyester resin and 4 parts of Pigment Blue 15:3, which pigment had a particle size of 0.1 micron average particle diameter as measured by transmission electron microscopy.

EXAMPLE VI

The process of Example III was repeated except that a magenta toner was prepared using Pigment Red 81:3 in place of the Pigment Blue 15:3.

The resulting magenta colored toner contained 96 parts of the linear polyester resin and 4 parts of Pigment Red 81:3, which pigment had a particle size of 0.1 micron average particle diameter as measured by transmission electron microscopy.

EXAMPLE VII

Repeating the procedure of Example I, a yellow toner was prepared using Pigment Yellow 185 in place of the Pigment Blue 15:3.

The resulting yellow colored toner contained 96 parts of the linear polyester resin and 4 parts of Pigment Yellow 185, which had a particle size of 0.3 micron average particle diameter as measured by transmission electron microscopy.

EXAMPLE VIII

A black toner was prepared as follows. In a Werner & Pfleiderer ZSK-28 twin screw extruder using the following process conditions: barrel temperature profile of 105°/110°/110°/115°/115°/115°/120° C., die head temperature of 140° C., screw speed of 250 revolutions per minute and average residence time of about three minutes with a processing rate of 6 pounds per hour, a mixture of 95 parts of the Example I linear polyester resin and 5 parts of carbon black REGAL 330® were mixed. The mixture was cooled (to about room temperature, 25° C. throughout) then micronized and classified using conventional jet mill process to 7 microns average volume median size. The resulting black colored toner contained 95 parts of linear polyester resin and 5 parts of carbon black, which carbon black pigment had a particle size of 0.01 micron average particle diameter as measured by transmission electron microscopy.

EXAMPLE IX

A number of full five process color bench samples were generated in a xerographic color machine text fixture using the combination of toners of Examples I, VI, and IV, V and VIII, the combination of Examples I, III, XI, V and X or a combination of Examples I, III, IV, IX and VIII. The resulting image brightness and saturation of colors showed that this combination of colorants provided an enlarged color gamut. Images made with only the cyan, magenta, yellow and black toners provided a color gamut which included 593 of the 1,000 pantone colors available. When the toner containing Pigment Orange 13 was added to the cyan, magenta, yellow and black toners, the gamut increased to include 666. Thus, when Orange 13 is added as a spot color, the increase in the number of pantone colors within the gamut is only from 593 to 594, one more color. When a toner containing well dispersed Orange 13 is used as a process color, reference the present invention, the increase is to 666 pantone colors. Also, other noninvention orange pigments did not possess the color strength or high enough chroma to expand the gamut to include as many, for example 666, pantone colors. The choice of the correct orange or green or violet pigment in the proper concentration is, therefore, of importance.

EXAMPLE X

A number of full five process color bench samples were generated by the process of Example IX using the combination of toners of Examples II, III, and IV, V and VIII, the combination of Examples I, III, XI, V and III and a combination of Examples I, III, IV, IX and VIII. The resulting image brightness and saturation of colors showed that this combination of colorants provided an enlarged color gamut. Images generated with only the cyan, magenta, yellow and black toners provided a color gamut which included 593 of the 1,000 pantone colors available. When the toner containing Pigment Orange 34 was added to the cyan, magenta, yellow and black toners, the gamut increased to include 654.

EXAMPLE XI

By repeating the procedure of Example I, a yellow toner was prepared with Pigment Yellow 17 instead of Pigment Blue 15:3.

The resulting yellow colored toner contained 96 parts of linear polyester resin and 4 parts of Pigment Yellow 17, which pigment had a particle size of 0.1 micron average particle diameter as measured by transmission electron microscopy.

EXAMPLE XII

By repeating the procedure of Example I, a magenta toner was prepared using Pigment Red 122 in place of the 15:3.

The resulting magenta colored toner contained 96 parts of the linear polyester resin and 4 parts of Pigment Red 122, which had a particle size of 0.1 micron average particle diameter as measured by transmission electron microscopy.

EXAMPLE XIII

By repeating the procedure of Example I, a magenta toner was prepared using Pigment Red 57:1 in place of the 15:3.

The resulting magenta colored toner contained 96 parts of the linear polyester resin and 4 parts of Pigment Red 57:1, which had a particle size of 0.1 micron average particle diameter as measured by transmission electron microscopy.

In embodiments, the dilution indicated herein to other pigment concentrations is not selected since, for example, the mass of the toners on the image controls the amount of pigment used.

Using a laboratory apparatus which allows deposition of a known toner mass, for single or layered samples, we produced examples using the five process colors. The resulting image brightness and saturation of colors of the images showed that this combination of five process color toners predispersed as described in Example III provided an expanded color gamut, and wherein each color reproduced was of excellent chroma and superior resolution.

It is expected that the combination of five process toners can be incorporated into an imaging apparatus, such as modified Xerox Corporation 5775 and 5760 full process color machines, and wherein, for example, each of five toners can be selected to develop and provide images of a variety of colors, and more specifically, any color that is present on the original being copied, and wherein the image copied is substantially the same as the original image in color, color resolution, and color intensity, and further wherein orange images can be obtained, or orange highlights generated.

Other modifications of the present invention may occur to those of ordinary skill in the art subsequent to a review of the present application, and these modifications, including equivalents thereof, are intended to be included within the scope of the present invention.

What is claimed is:

1. A process for the preparation of a combination of five toners wherein the five toners are comprised of a cyan toner, a magenta toner, a yellow toner, an orange toner, and a black toner, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine a monoazo, or a benzimidazolone, the pigment for the orange toner is Orange 13, Orange 34, Orange 5, Orange 16, Orange 36, Orange 46, Orange 67, or Orange 69, and the pigment for the black toner is carbon black, which process comprises dispersing each of said cyan, magenta, orange, and yellow pigments by flushing said cyan, magenta, or orange, and yellow pigment into said toner resin, and wherein the water is substantially removed to generate pigmented resin containing from about 25 to about 50 weight percent of pigment based on the weight percent of said toner resin and said pigment; and wherein each of the resulting pigmented resin concentrate product is mixed and diluted with additional toner resin to generate cyan, magenta, orange, and yellow toners containing each of said cyan, magenta, orange, and yellow pigments, respectively, in an amount of from about 2 to about 20 weight percent based on the weight percent of resin and pigment, and wherein each of said cyan, magenta, orange, and yellow pigments have a particle diameter size or agglomerate diameter size of from about 0.01 micron to about 3 microns, and wherein the resin for each toner is a linear polyester, a crosslinked polyester, a gel containing polyester, or mixtures thereof, and said black pigment possesses a particle size diameter of about 0.001 micron.

2. A process in accordance with claim 1 wherein each of said pigments for said toners, excluding black, is prepared by dispersing said pigments with a polymeric alcohol.

3. A process in accordance with claim 1 wherein said cyan pigment is Pigment Blue 15:3 having a Color Index Constitution Number of 74160, said magenta pigment is Pigment Red 81:3 having a Color Index Constitution Number of 45160:3, and said yellow pigment is Pigment Yellow 17 having a Color Index Constitution Number of 21105.

4. A process in accordance with claim 1 wherein each of said cyan, magenta, orange, and yellow pigments, respectfully, are present in an amount of from about 2 to about 15 weight percent, and said cyan, magenta, orange, and yellow pigments have a particle diameter size or agglomerate diameter size of from about 0.01 to about 3 microns.

5. A process in accordance with claim 2 wherein said alcohol is selected in an amount of from about 2 percent by weight to about 10 percent by weight based on the weight of resin, pigment and alcohol, wherein the alcohol has a molecular weight of about 425 g/mole.

* * * * *